US011518574B2

(12) United States Patent
Hsu

(10) Patent No.: US 11,518,574 B2
(45) Date of Patent: Dec. 6, 2022

(54) STRUCTURE OF STORAGE BOX

(71) Applicant: L&F PLASTICS, CO., LTD., Miaoli County (TW)

(72) Inventor: Mu-Chuan Hsu, Miaoli County (TW)

(73) Assignee: L&F PLASTICS, CO., LTD., Miaoli County (TW)

( * ) Notice: Subject to any disclaimer, the term of this patent is extended or adjusted under 35 U.S.C. 154(b) by 51 days.

(21) Appl. No.: 16/916,557

(22) Filed: Jun. 30, 2020

(65) Prior Publication Data

US 2021/0002026 A1 Jan. 7, 2021

(30) Foreign Application Priority Data

Jul. 3, 2019 (TW) ..... 108123600

(51) Int. Cl.
*B65D 21/02* (2006.01)
*B65D 43/02* (2006.01)
*B65D 25/20* (2006.01)

(52) U.S. Cl.
CPC ..... *B65D 21/0223* (2013.01); *B65D 21/0219* (2013.01); *B65D 25/20* (2013.01); *B65D 43/0208* (2013.01)

(58) Field of Classification Search
CPC ..... B65D 21/0223; B65D 21/0219; B65D 43/0208; B65D 43/161
USPC ..... 206/508
See application file for complete search history.

(56) References Cited

U.S. PATENT DOCUMENTS 4,260,069 A * 4/1981 Juergens ..... B65D 43/0202 220/812
5,038,937 A * 8/1991 DiSesa, Jr. ..... B65D 21/064 206/508
5,445,397 A * 8/1995 Evans ..... B62B 1/10 206/508
5,673,811 A * 10/1997 Dickinson ..... B65D 43/02 220/815
7,789,238 B2 * 9/2010 Claypool ..... A47J 47/04 206/508

(Continued)

FOREIGN PATENT DOCUMENTS

GB 2271982 A * 5/1994 ..... B65D 21/0223
JP 6568330 B1 * 8/2019 ..... B65D 25/005
KR 20160004455 U * 12/2016 ..... B65D 25/005

(Continued)

*Primary Examiner* — Steven A. Reynolds
(74) *Attorney, Agent, or Firm* — Alan D. Kamrath; Karin L. Williams; Mayer & Williams PC

(57) ABSTRACT

A structure of a storage box includes a main body, a stacking assembly, and a forward opening. The main body has an upper and front-facing opening and a recess on the rear. The stacking assembly is attached to the main body, covers the upper and front-facing opening, and has an upper cover and a front cover, the upper cover fitted to the front cover with a snap and having a convex portion, the shape of the convex portion identical to the shape of the recess. The forward opening is a part of the upper and front-facing opening of the main body and is covered by the front cover. When two or more storage boxes are stacked, the convex portion of the second storage box embeds the recess of the first storage box, preventing the entire structure from tilting forward when the front cover of the storage box above is opened.

6 Claims, 18 Drawing Sheets

(56) References Cited

U.S. PATENT DOCUMENTS

| | | | | |
|---|---|---|---|---|
| 2008/0312054 | A1* | 12/2008 | Boland | B65D 15/08<br>493/102 |
| 2017/0129097 | A1* | 5/2017 | Engvall | B25H 1/04 |

FOREIGN PATENT DOCUMENTS

| | | | |
|---|---|---|---|
| TW | I5601158 | B | 12/2016 |
| TW | M552902 | U | 12/2017 |

* cited by examiner

STRUCTURE OF STORAGE BOX

TECHNICAL FIELD

Provided by the present invention is an improved structure of a storage box, principally comprising a storage box with a front cover that can be pivotally connected to a main body to achieve stable temporary limitation of its orientation through simple implementation, or with respect to storage boxes covered with a front cover and upper cover being stacked up, a convex portion extending from the back section of the upper cover which can be introduced into the corresponding concave portion of the main body above to prevent the stacked upper storage box from tilting forward when the front cover is opened to insert or remove items.

BACKGROUND

At present, a large number of storage boxes used to store various types of objects exist, among which plastic shaped boxes with preset shapes that are easy to move are extremely common. Existing storage boxes basically make use of box bodies of a preset volume and shape formed from suitably strong plastic, while the upper opening of the box body can be covered with a cover of the desired shape so that objects are shielded from the outside after being placed within it.

Such storage boxes offer the function of convenient storage, however in addition to this single form of a cover used to cover the top end of the storage box, there are also a large number which have an opening extending to the front end and a front cover which limit the orientation, which in addition to being able to be lifted up to open, can also be slid open as appropriate for the sake of convenience, e.g. the patent for a "Storage Container" with publication number: 1560115, and utility model patent of Republic of China (Taiwan) for "Improved Structure of a Storage Box (21)" with publication number: M552902, both of which make reference to the use of covers to respectively cover the upper and front openings of storage boxes for the convenience of the user in opening the cover in the suitable orientation according to the particular arrangement in order to insert or remove objects. In this respect, by combining a front cover with the front opening of the storage box referred to in the latter document, the application of the opening/closing components is improved, so that the front cover can be pivotally connected to the body through simple implementation, being temporarily limited in a stable orientation or for storage boxes covered with a front cover and upper cover, when being stacked up, the convex portion extending from the back section of the upper cover can be introduced into the corresponding concave portion of the main body above to prevent the stacked upper storage box from tilting forward when the front cover is opened to insert or remove items.

BRIEF SUMMARY OF THE INVENTION

The present invention is based on the design of a storage box used to store objects in which stable temporary limitation of its orientation is achieved through the simple implementation of the front-facing opening of the main body coordinating with the front cover to limit the orientation, wherein a stacking assembly is formed by snap fitting the upper cover and front cover used to cover the upper and front-facing openings of the main body together before being attached, and using said stacking assembly to limit the orientation with the upper periphery of the main body, so that when the forward opening of the main body requires covering, the front cover snap fitted to the lower side of the stacking assembly is slid by hand so that it is disengaged and smoothly displaced along the flat surfaces formed on both sides of the main body, and when the front cover is turned down to cover the forward opening of the main body to the limit, the recessed area of the upper section hangs on the convex portion of the corresponding part, so that a stable temporary limitation is provided between the front cover and the main body; and when storage boxes containing items require being stacked on top of one another, through a concave portion of a recess on the rear of the main body above, a convex portion on the corresponding part of the upper cover of the storage box below is introduced in order to prevent the entire structure from tilting forward when the front cover of the storage box above is opened in order to insert of remove items.

The primary aim of the present invention is to provide a storage box used to store objects which comprises a main body of a predetermined shape, and an upper cover and front cover respectively corresponding to the connected or non-connected opening formed in the upward orientation and forward orientation of the main body; in this respect, stable temporary limitation of the orientation of the storage box is achieved through the simple implementation of the front-facing opening of the main body coordinating with the front cover to limit the orientation, achieved by the following: a stacking assembly being formed by snap fitting the upper cover and front cover used to cover the upper and front-facing openings of the main body together before being attached, and using said stacking assembly to limit the orientation with the upper periphery of the main body, so that when the forward opening of the main body requires covering, the front cover snap fitted to the lower side of the stacking assembly is slid by hand so that it is disengaged and smoothly displaced along the flat surfaces formed on both sides of the main body, and when the front cover is turned down to cover the forward opening of the main body to the limit, the recessed area of the upper section hangs on the convex portion of the corresponding part, so that a stable temporary limitation is provided between the front cover and the main body; and when storage boxes containing items require being stacked on top of one another, through a concave portion of a recess on the rear of the main body above, a convex portion on the corresponding part of the upper cover of the storage box below is introduced in order to prevent the entire structure from tilting forward when the front cover of the storage box above is opened in order to insert of remove items.

A second aim of the present invention is to provide a storage box comprising a stacking assembly formed by snap fitting the upper cover and front cover together, which is achieved by the following: at the corresponding front and back sections of the inside of said upper cover is formed a limiting section which maintains a preset height interval, and a preset height snap portion facing the limiting section, so that when the front cover is correspondingly positioned, the lower concave portion on one side of the periphery can be pushed in and held by said limiting section, and the periphery on the other side of the front cover snaps into the snap portion so that the entire front cover is snapped to the inner surface of the upper cover; a predetermined part of the inner periphery of the upper cover is a clasp portion which has several channels so that in coordination with the main body, the cover of the upper opening is able to snap into the bottom portion of an annular flange A third aim of the present invention is to provide a storage box comprising a groove recessed into a preset section of the inside of the upper cover, into which a coordinating reinforcing panel is placed for additional strength when storage boxes are stacked on top of each other.

A fourth aim of the present invention is to provide a storage box comprising a lower surface formed on a preset section of the inside of the main body towards its front, so that the front cover on the bottom of the stacking assembly can be pushed in or slid out along said flat surface by means of the slightly protruding rounded convex portion on either side.

A fifth aim of the present invention is to provide a storage box comprising a concave portion protruding from the back section of the upper cover of the upper opening of the main body which matches the bottom adjacent concave portion on the bottom of the main body of the storage box into which it can be introduced when stacking so as to make the stacking between storage box and storage box more stable; and at the bottom of the main body, the preset corners are protruded with a plurality of convex portions which match the recessed area recessed in the middle of the upper cover which covers the upper opening of the main body when being stacked.

A sixth aim of the present invention is to provide a storage box comprising a raising support of extending channels on a predetermined part of the outer side of the upper periphery of the main body, which when multiple main bodies are not being used and are stacked with one another, said raising support is positioned in the corresponding indented section of the adjacent main body below to maintain an appropriate interval and facilitate being unstacked for further use.

A seventh aim of the present invention is to provide a storage box comprising a concave portion recessed on both sides at the rear of the upper cover which covers the upper opening of the main body, and allows the snap fitted stacking assembly of the upper cover and front cover when not in use and being stacked with one another to be introduced into the rounded convex portion on the corresponding part of the front cover on the inside so that the upper and lower stacking assemblies can be stacked in a stable manner.

DETAILED DESCRIPTION

Figure 4:
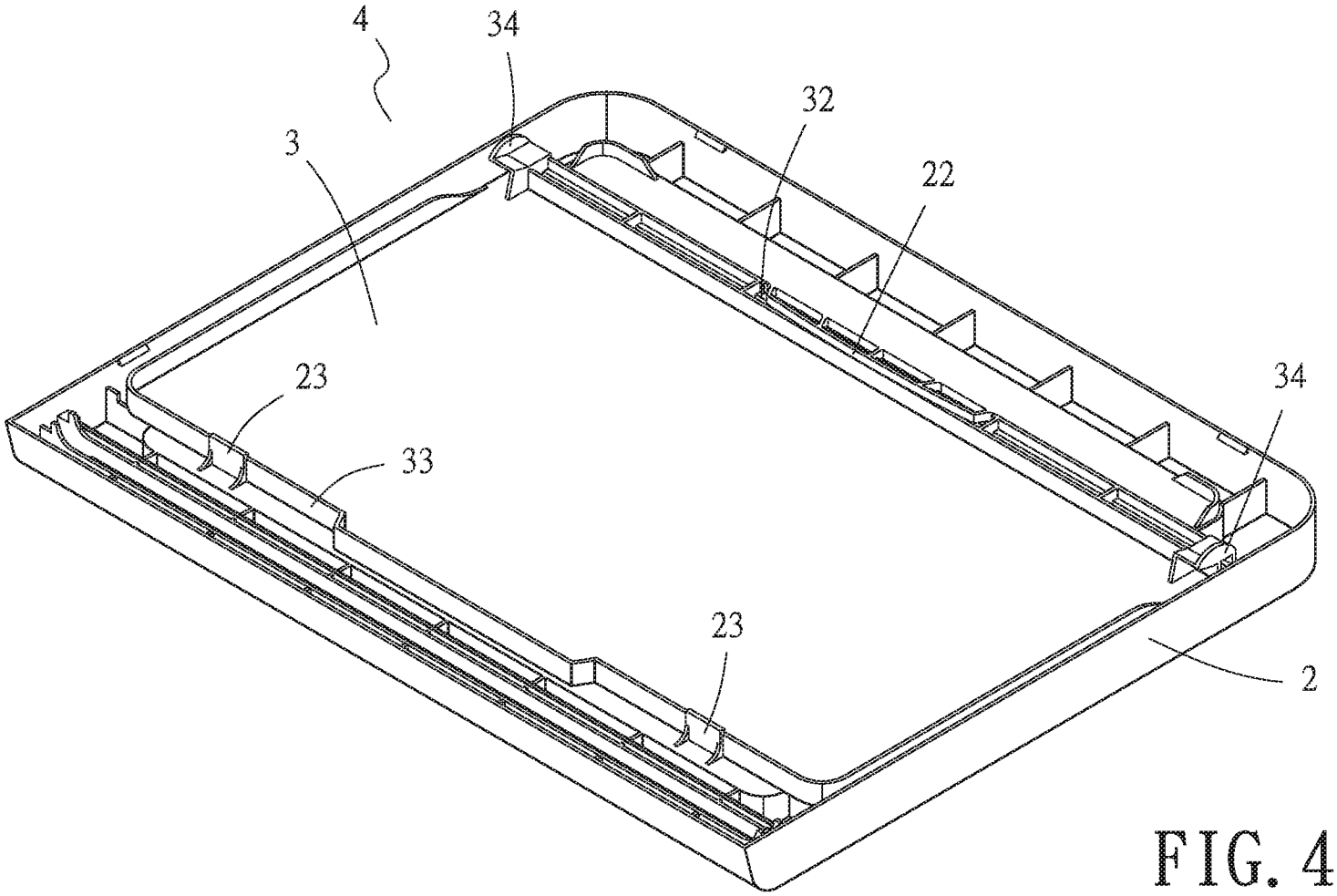
FIG. 4 is a schematic diagram of the upper cover and front cover of the present invention once snap fitted (reverse position)
Figure 5:
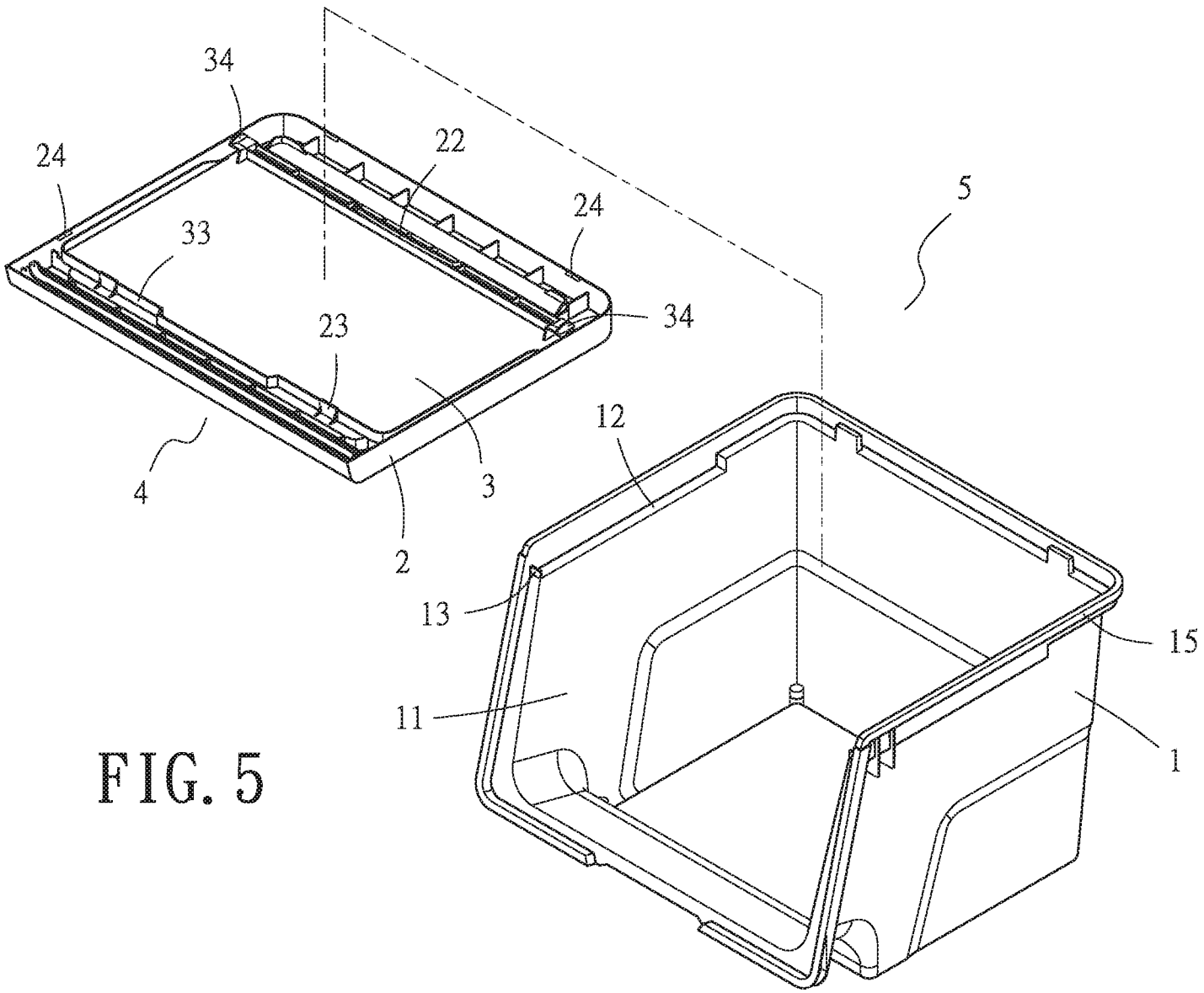
FIG. 5 is a schematic diagram of the main body and snap fitted stacking assembly of the upper cover and front cover of the present invention before being attached.
Figure 6:
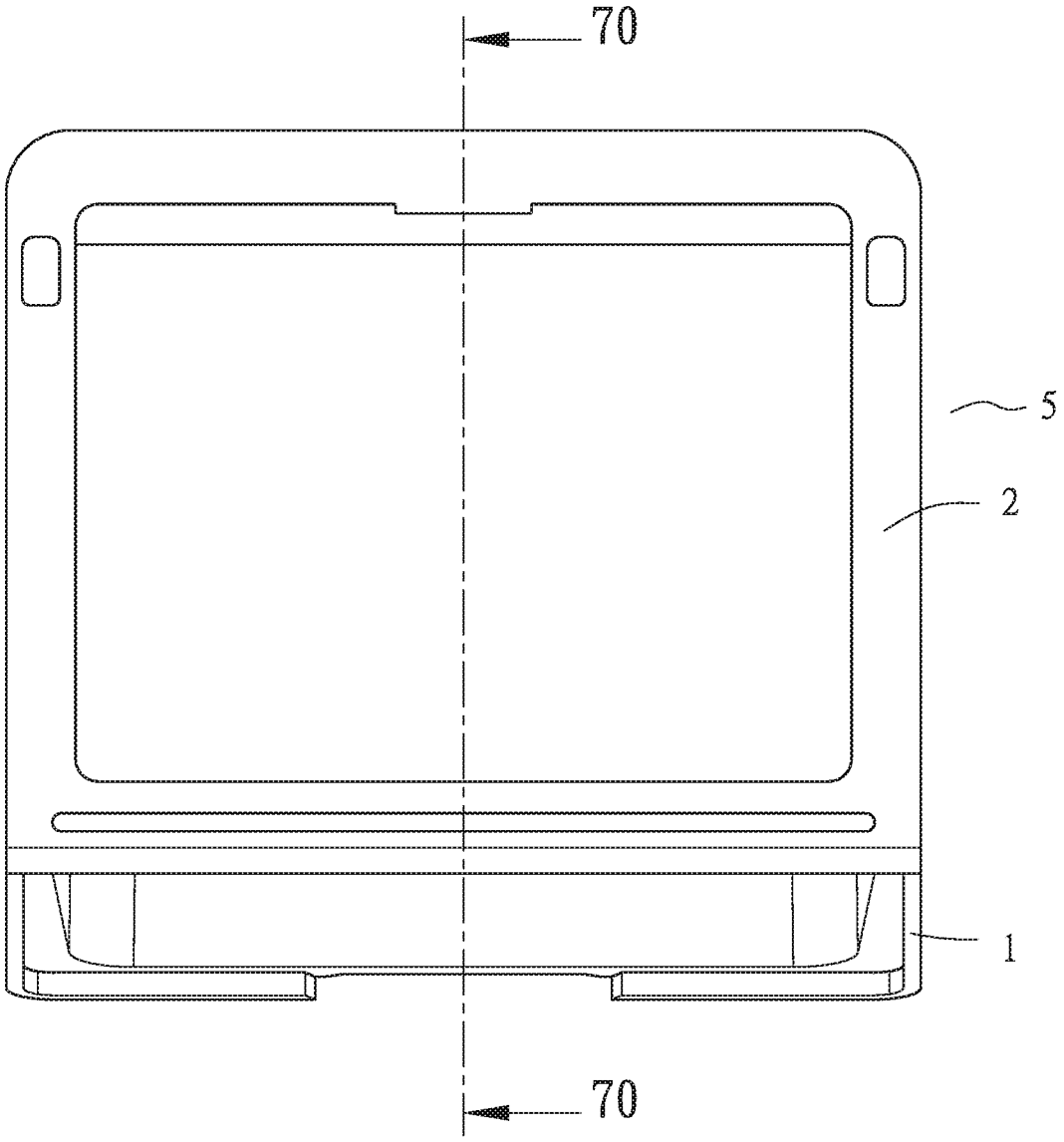
FIG. 6 is a top view of the main body and snap fitted stacking assembly of the upper cover and front cover of the present invention once attached.
Figure 7:
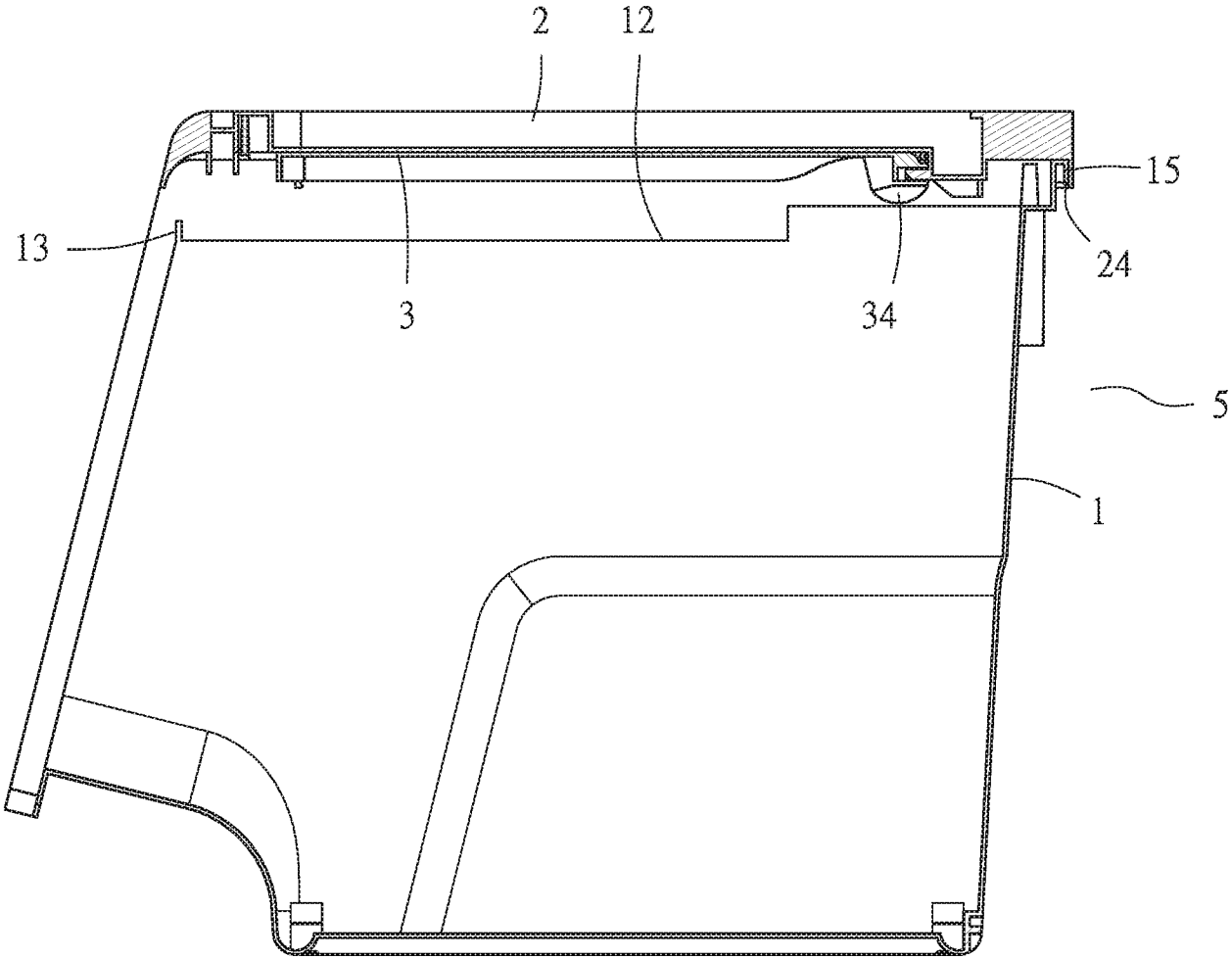
FIG. 7 is a sectional view of the portion 70-70 in FIG. 6.
Figure 8:
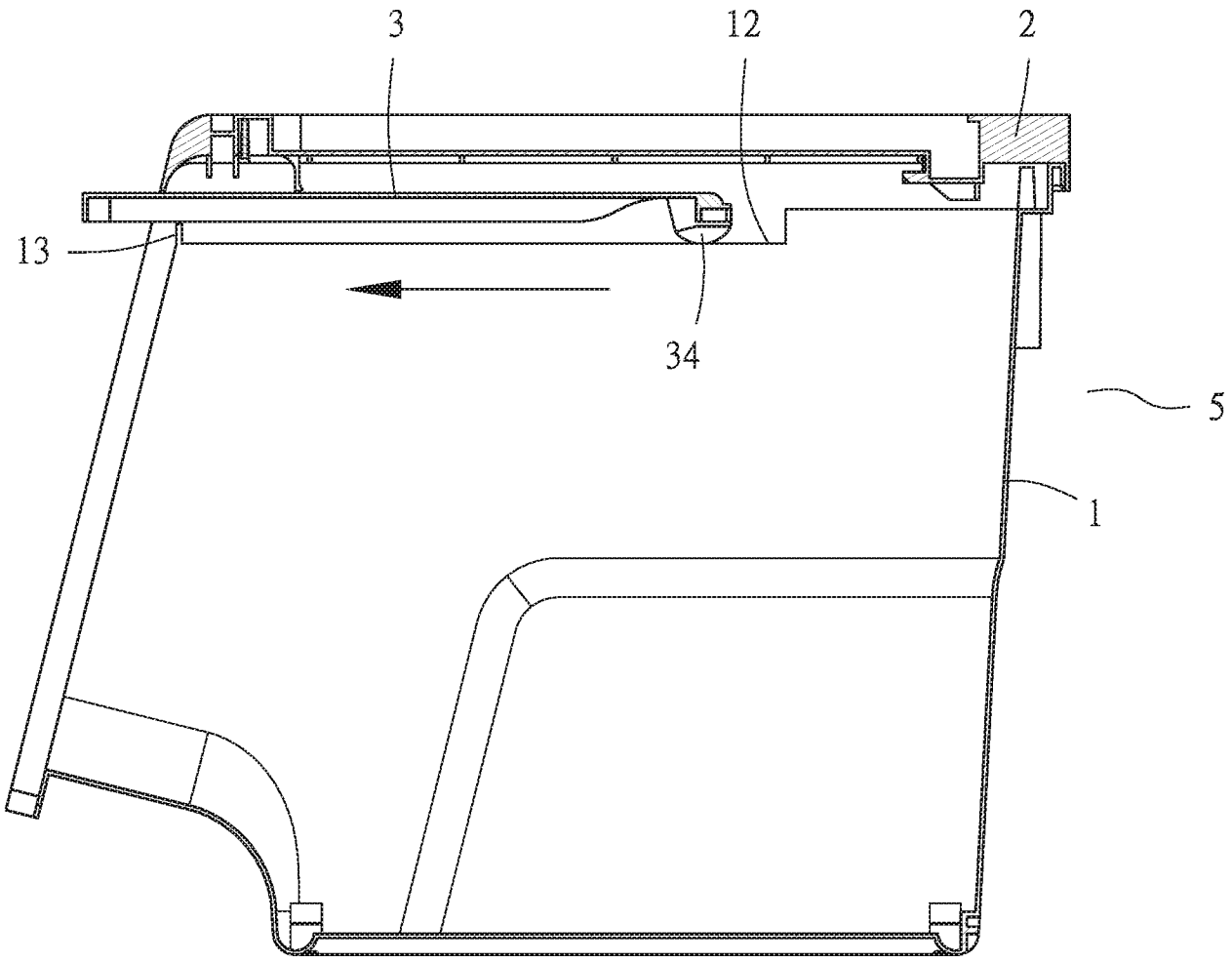
FIG. 8 is an embodiment diagram of the front cover in FIG. 7 being moved out.
Figure 9:
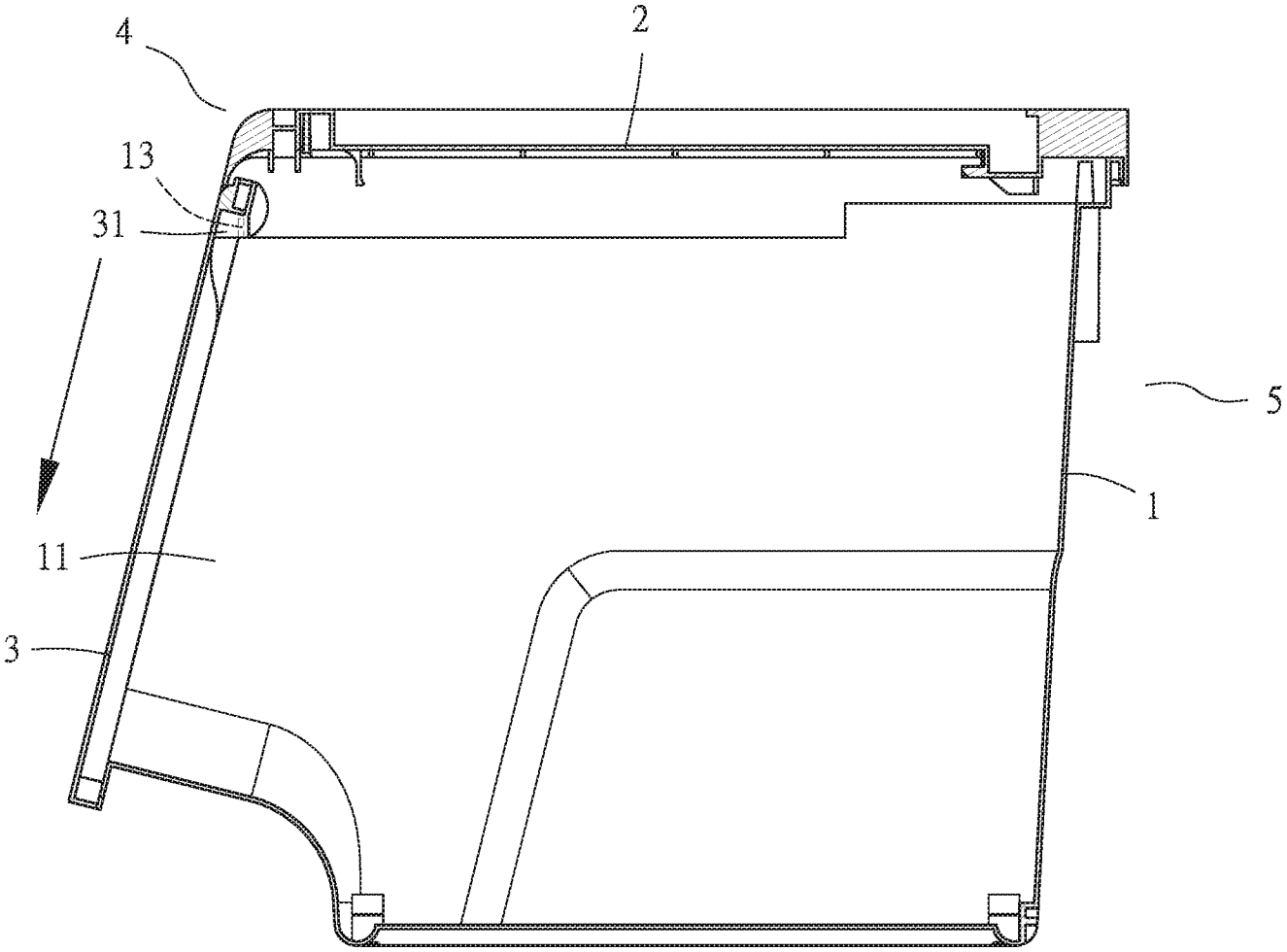
FIG. 9 is an embodiment diagram of the front cover in FIG. 8 being turned down to cover the front of the main body.
Figure 10:
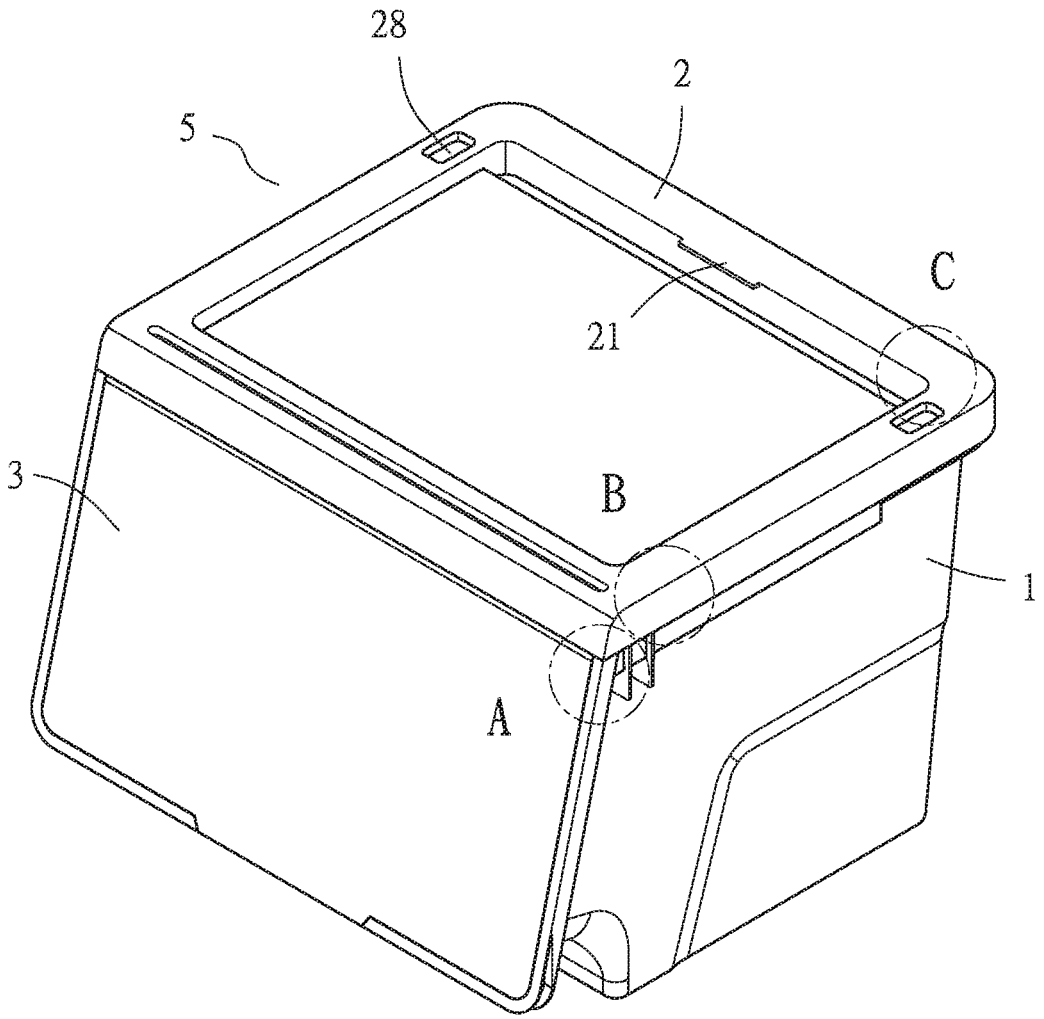
FIG. 10 is an exterior view of FIG. 9.
Figure 10A:
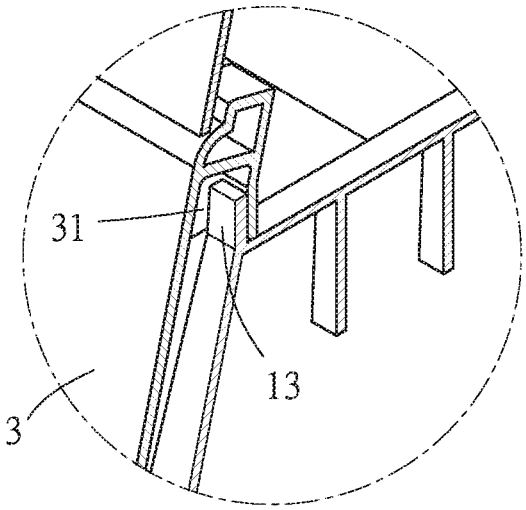
FIG. 10A is a sectional view of A in FIG. 10.
Figure 11:
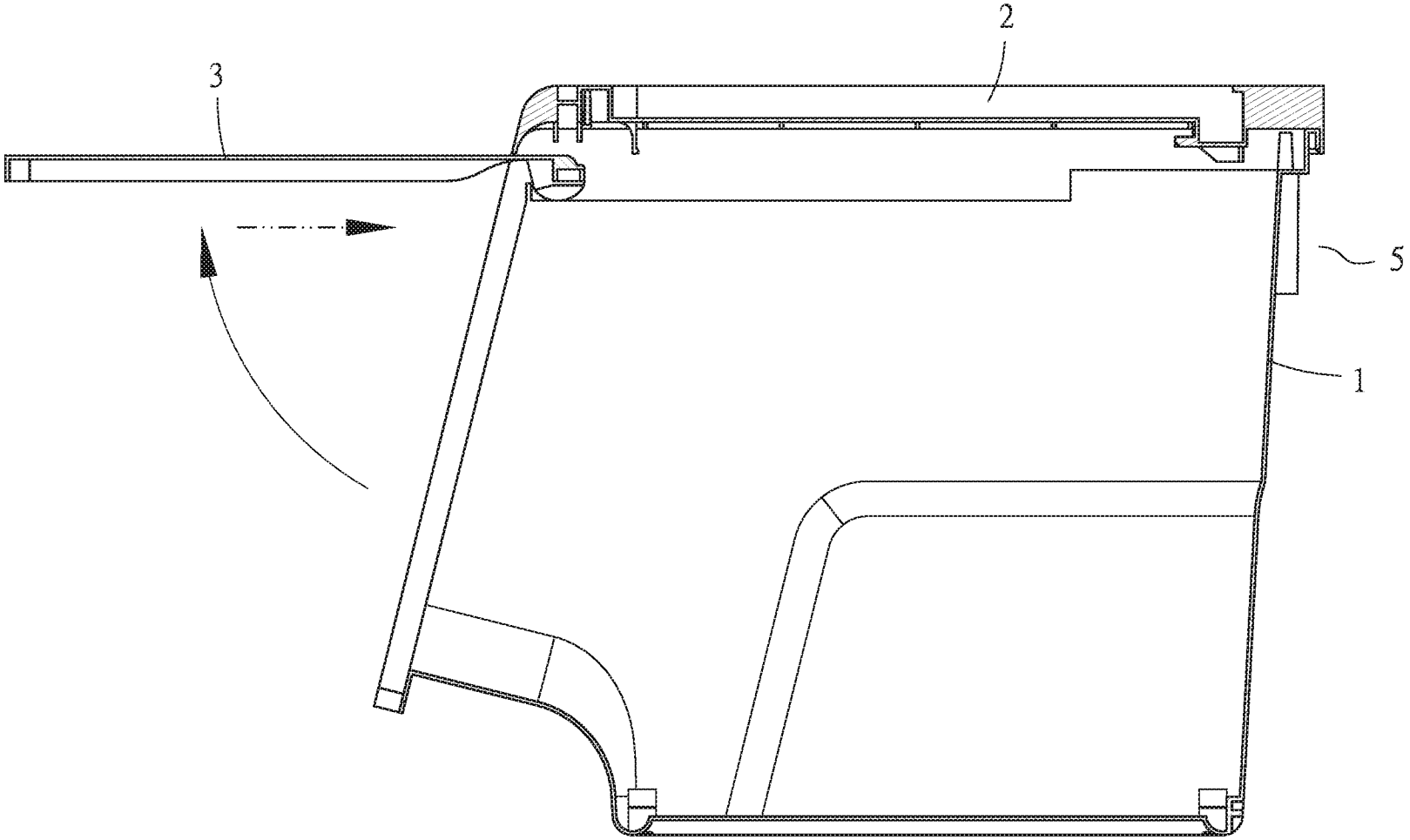
FIG. 11 is a side embodiment diagram of the front cover of the storage box of the present invention being lifted up and pushed into the main body.
Figure 12:
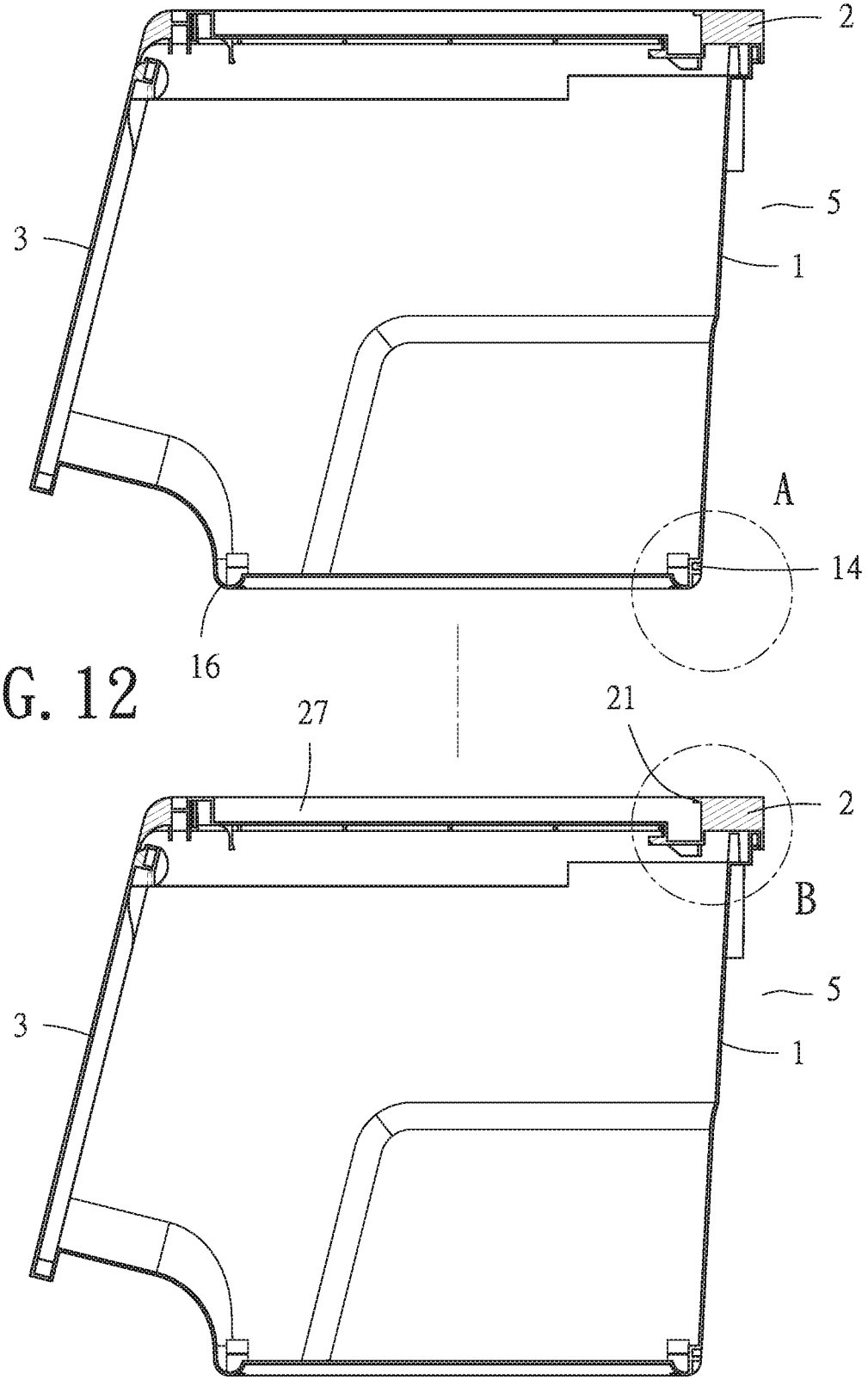
FIG. 12 is a cross sectional side view of the upper and lower storage boxes of the present invention when not being stacked.
Figure 12A:
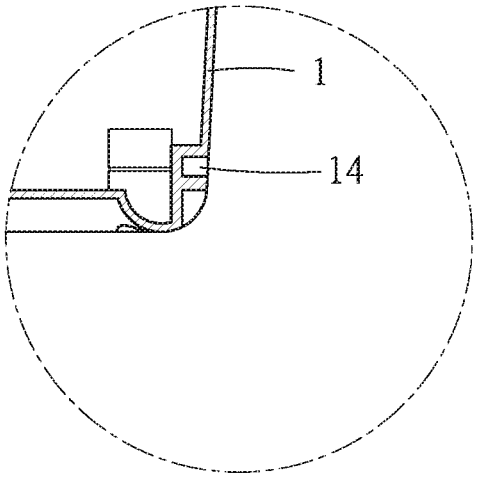
FIG. 12A is an enlarged view of A in FIG. 12.
Figure 12B:
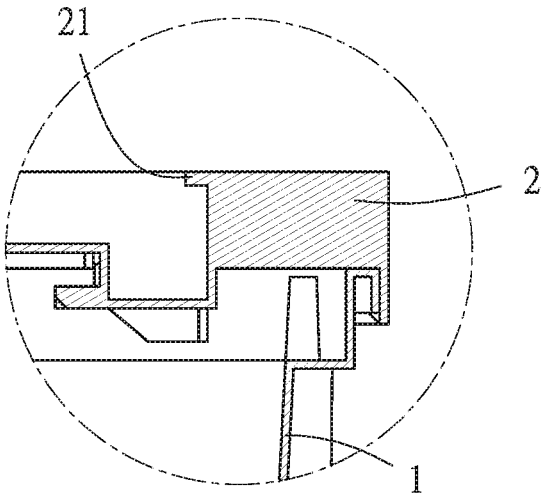
FIG. 12B is an enlarged view of B in FIG. 12.

The design of the improved structure of a storage box of the present invention (as shown in FIG. 5) principally consists of a storage box (5) used to store objects which comprises a main body (1) of a predetermined shape, and an upper cover (2) and front cover (3) respectively corresponding to the connected or non-connected opening (11) formed in the upward orientation and forward orientation of the main body (1); the means claimed in this creation is: maintaining stable temporary limitation of the orientation through the simple implementation of the front-facing opening of the main body (1) of the storage box (5) coordinating with the front cover (3) to limit the orientation, achieved by the following: a stacking assembly (4) (as in FIGS. 3 and 4) being formed by snap fitting the upper cover (2) and front cover (3) used to cover the upper and front-facing openings (11) of the main body (1) together before being attached, and using said stacking assembly (4) to limit the orientation with the upper periphery of the main body (1) (as shown in FIGS. 5, 6 and 7), so that when the forward opening (11) of the main body (1) requires covering, the front cover (3) snap fitted to the lower side of the stacking assembly (4) is slid by hand so that it is disengaged from the stacking assembly (4) and smoothly displaced along the flat surfaces (12) formed on both sides of the main body (1) (being moved out as shown in FIG. 8, and being moved in when the front cover is lifted in order to rotate as shown in FIG. 11), and when the front cover (3) is turned down to cover the forward opening (11) of the main body (1) to the limit, the recessed area (31) of the upper section of the front cover (3) hangs on the convex portion (13) (as shown in FIGS. 9 and 10), so that a stable temporary limitation is provided between the front cover (3) and the main body (1); and when storage boxes (5) containing items require being stacked on top of one another, through a concave portion (14) of a recess on the rear of the main body (1) above (as shown in FIGS. 12 and 12A), a convex portion (21) on the corresponding part of the upper cover (2) of the storage box (5) below (as shown in FIG. 12B) is introduced in order to prevent the entire structure from tilting forward when the front cover (3) of the storage box (5) above is opened in order to remove items.

Figure 3:
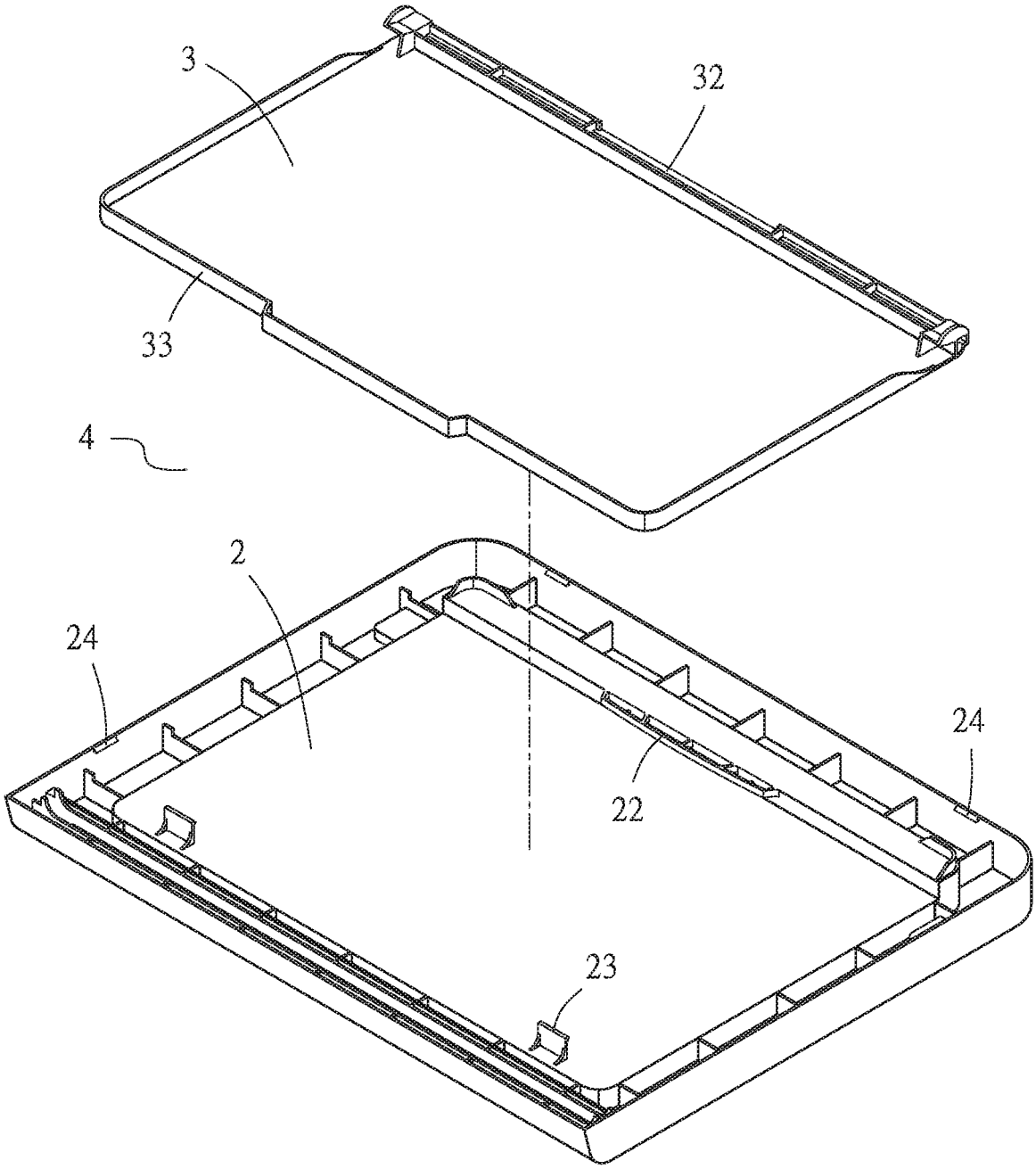
FIG. 3 is a schematic diagram of the upper cover and front cover of the present invention before being snap fitted (reverse position).
Figure 10B:
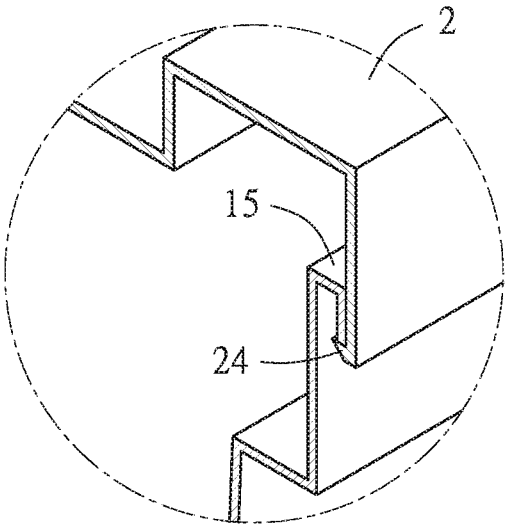
FIG. 10B is a sectional view of B in FIG. 10.
Figure 10C:
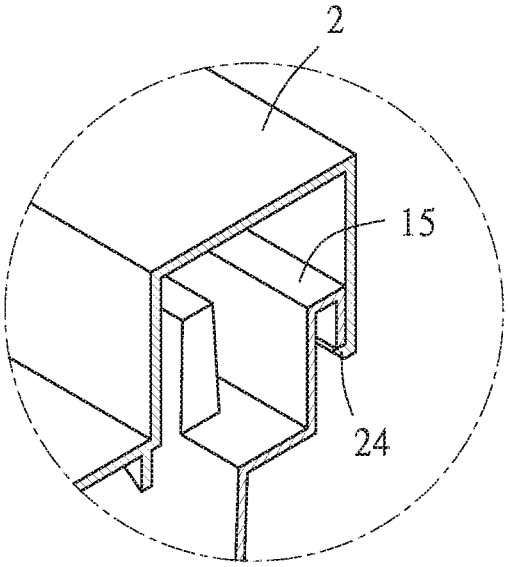
FIG. 10C is a sectional view of C in FIG. 10.

The storage box (5) referred to above includes a stacking assembly (4) (as shown in FIG. 3) formed by snap fitting the upper cover (2) and front cover (3), which is achieved by the following: at the corresponding front and back sections of the inside of said upper cover (2) is formed a limiting section (22) which maintains a preset height interval, and a preset height snap portion (23) facing the limiting section (22), so that when the front cover (3) is correspondingly positioned, the lower recessed portion (32) on one side of the periphery can be pushed in and held by said limiting section (22) (as shown in FIG. 4), and the periphery (33) on the other side of the front cover (3) snaps into the snap portion (23) so that the entire front cover (3) is snapped to the inner surface of the upper cover (2); a predetermined part of the inner periphery of the upper cover (2) is a clasp portion (24) which has several channels (as shown in FIG. 5) so that in coordination with the main body (1), the cover of the upper opening (11) is able to snap into the bottom portion of an annular flange (15) of the corresponding periphery (as shown in FIGS. 7, 10B and 10C).

Figure 1:
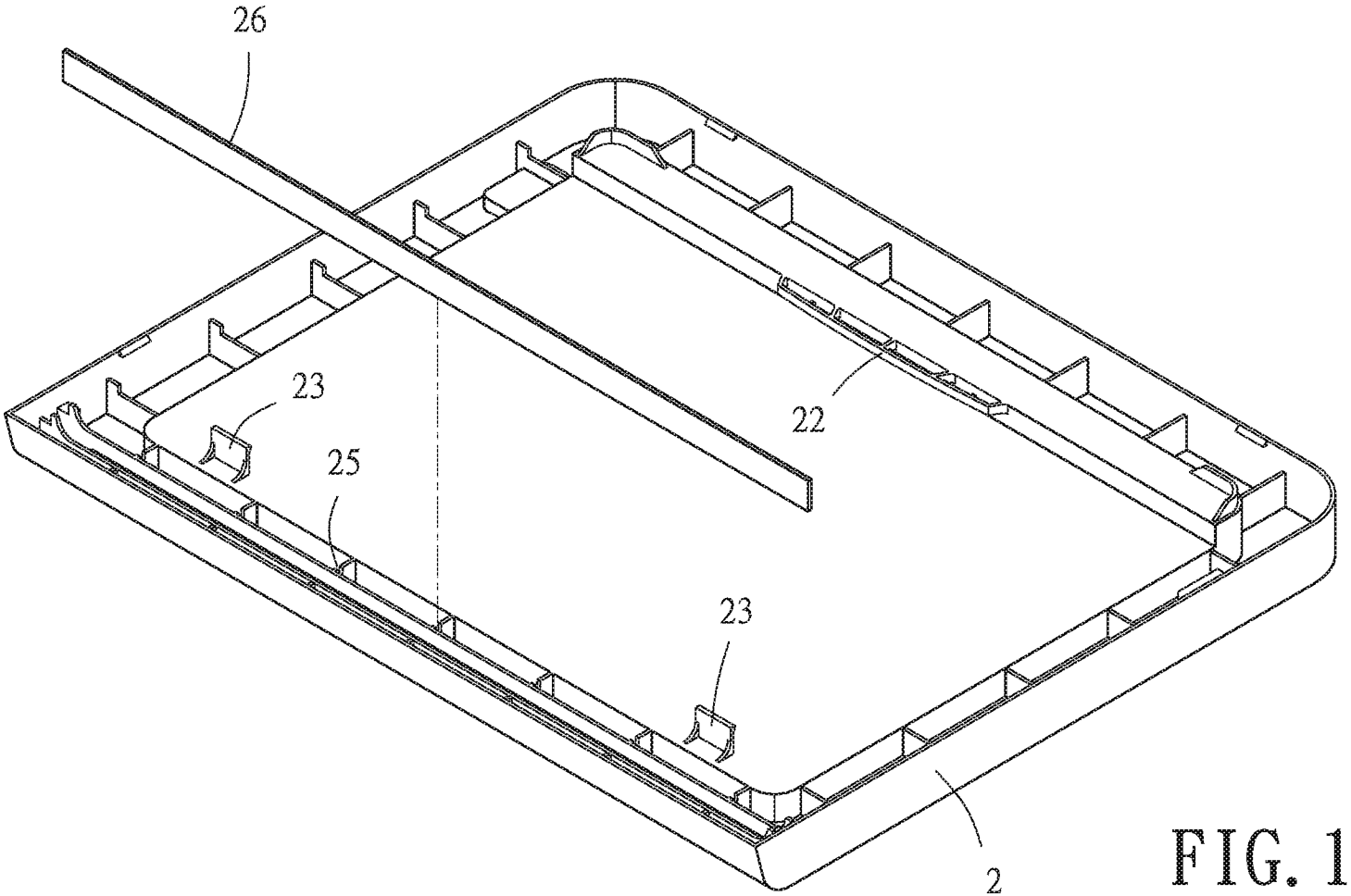
FIG. 1 is an exploded view of the top cover and reinforcing panel of the present invention.
Figure 2:
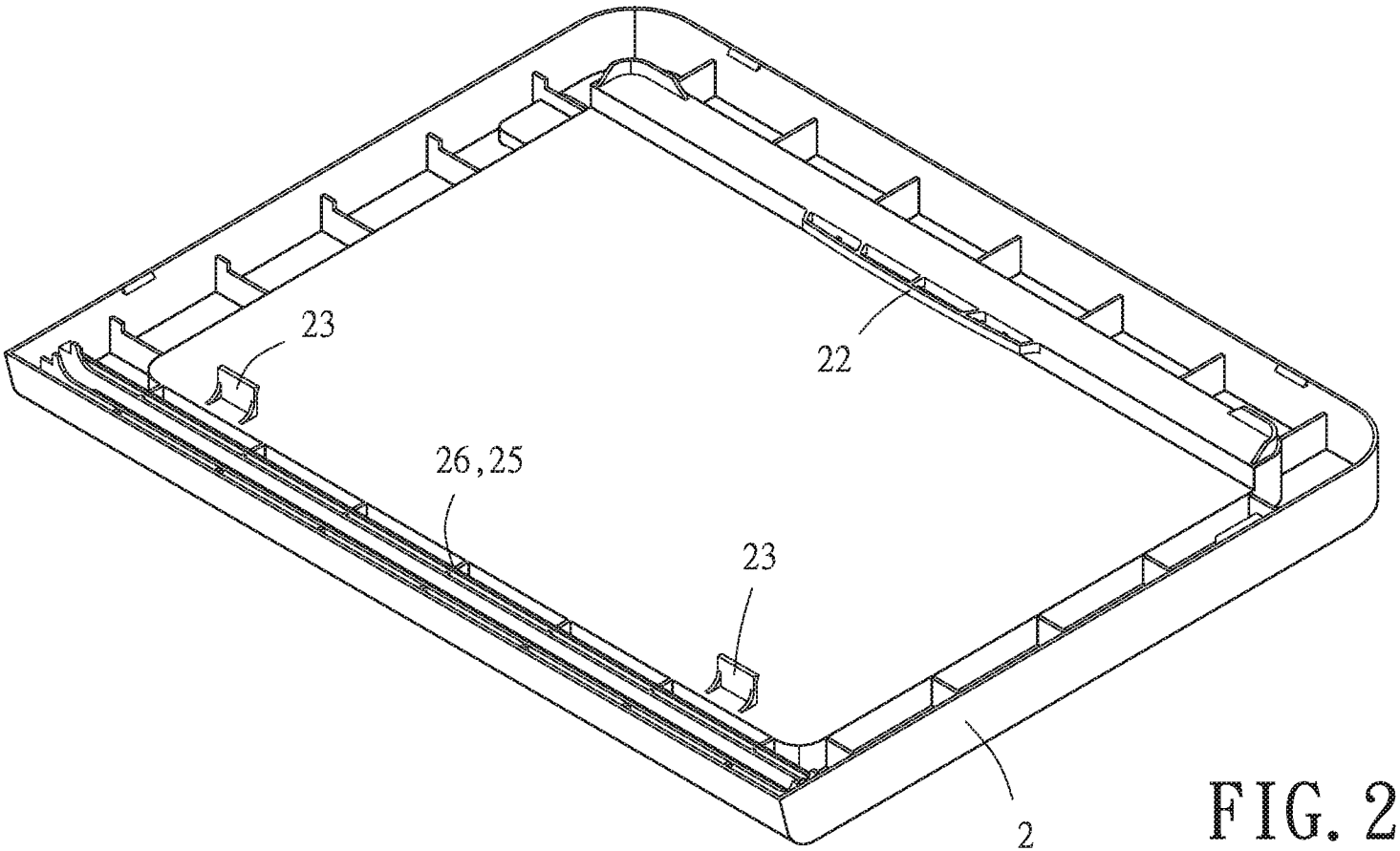
FIG. 2 is a reverse external view of exploded view of the top cover and reinforcing panel of the present invention.
Figure 13A:
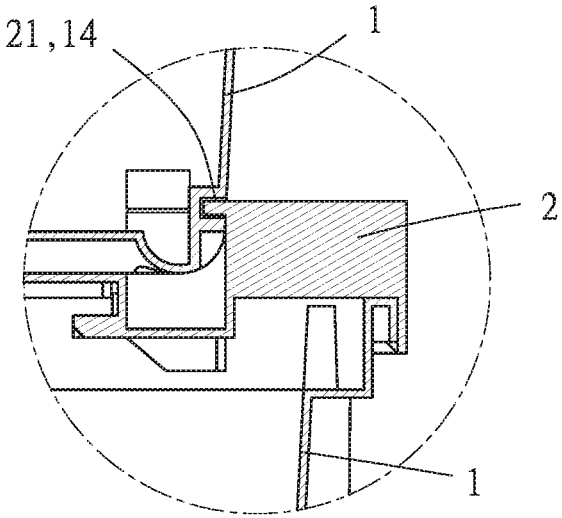
FIG. 13A is an enlarged view of A in FIG. 13.
Figure 13:
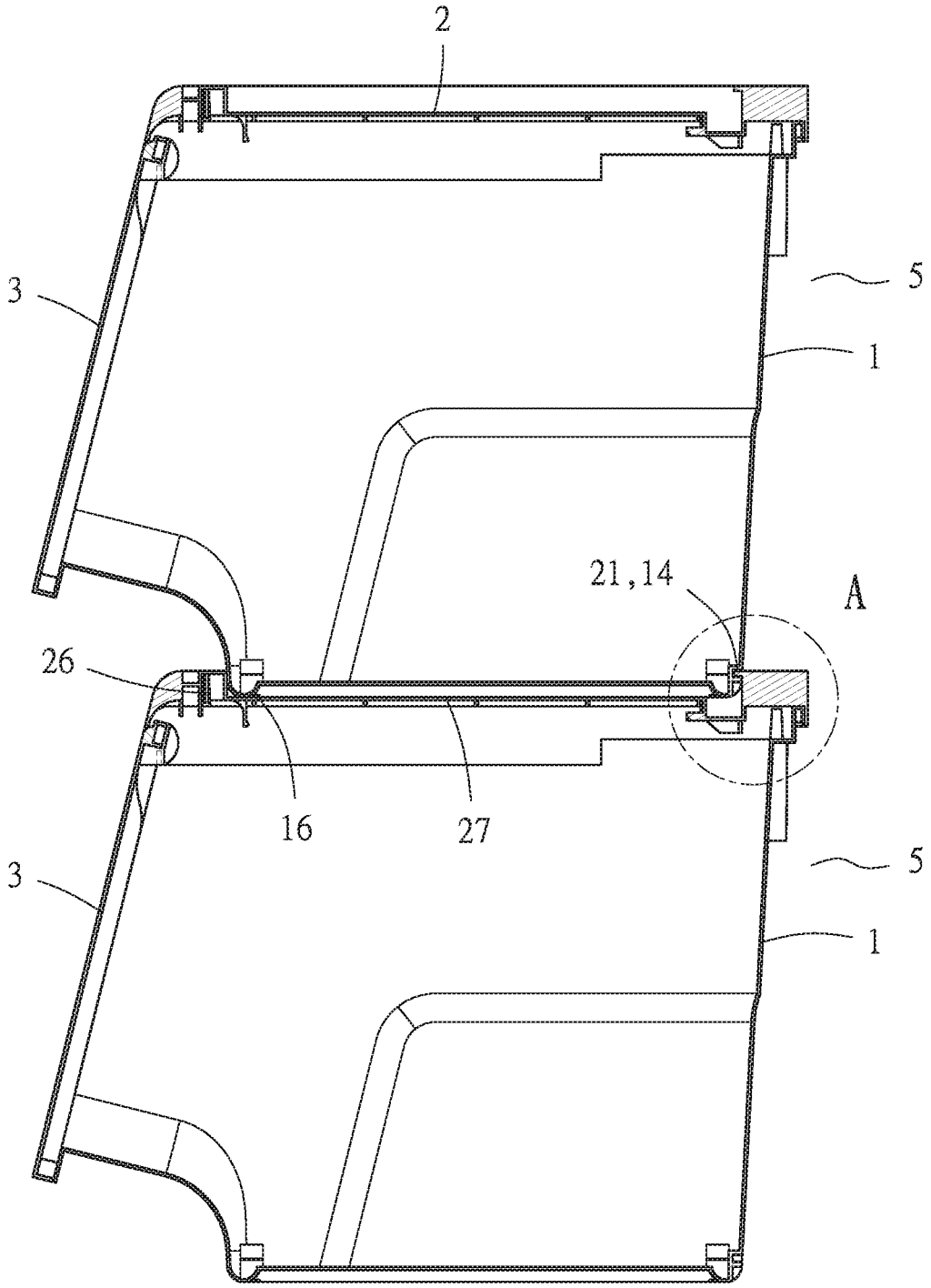
FIG. 13 is a cross sectional side view of the upper and lower storage boxes of the present invention once stacked.

The storage box (5) referred to above includes a groove (25) recessed into a preset section of the inside of the upper cover (2) (as shown in FIG. 1), into which a coordinating reinforcing panel (26) (a metal panel is used in this embodiment) is placed (as shown in FIG. 2) for additional strength when storage boxes (5) are stacked on top of each other (as shown in FIG. 13).

The storage box (5) referred to above includes a lower surface (12) formed on a preset section of the inside of the main body (1) towards its front (as shown in FIG. 5), so that the front cover (3) on the bottom of the stacking assembly (4) can be pushed in or slid out along said flat surface (12) by means of the slightly protruding rounded convex portion (34) on either side (as shown in FIG. 11 being pushed in, and in FIG. 8 being pulled out).

The storage box referred to above includes a concave portion (21) protruding from the back section of the upper cover (2) of the upper opening of the main body (1) (as shown in FIG. 12) which matches the bottom adjacent concave portion (14) on the bottom of the main body (1) of the storage box (5) into which it can be introduced when stacking (as shown in FIG. 13) so as to make the stacking between storage box (5) and storage box (5) more stable; and at the bottom of the main body (1), the preset corners are protruded with a plurality of convex portions (16) which match the recessed area (27) recessed in the middle of the upper cover (2) which covers the upper opening of the main body (1) when being stacked.

Figure 14:
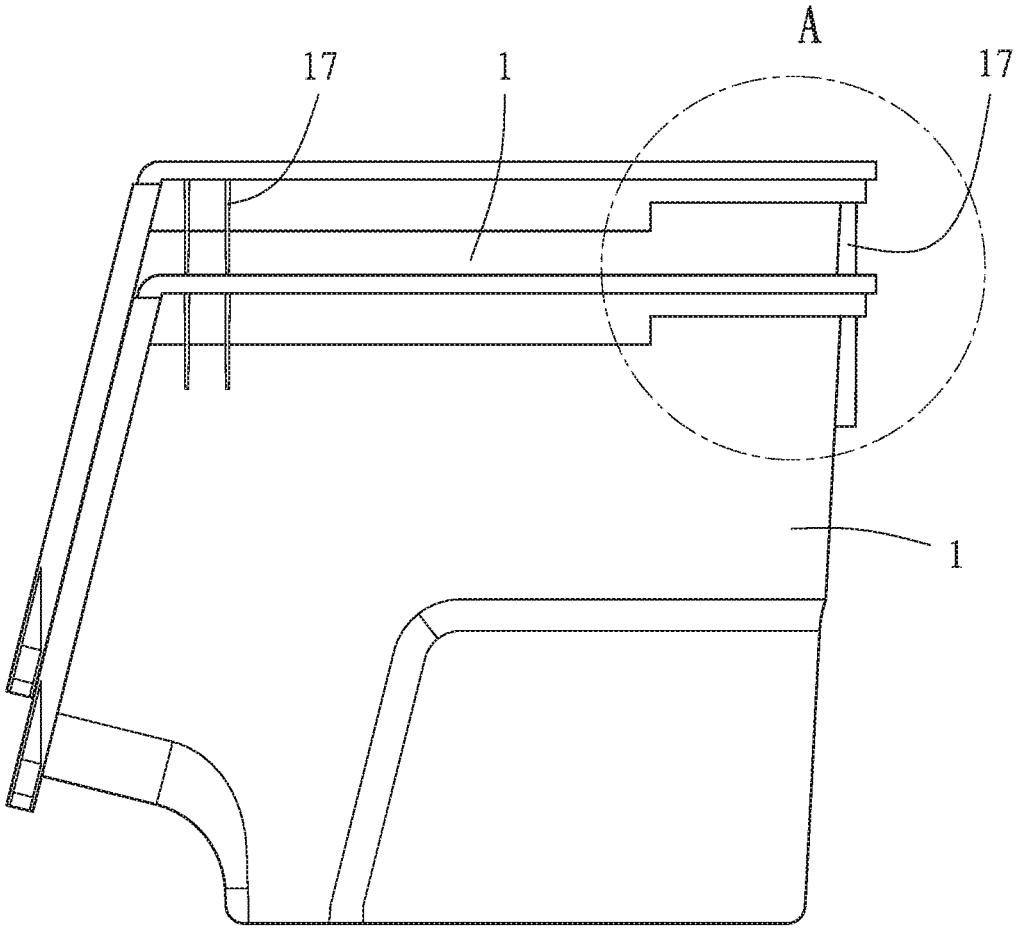
FIG. 14 is a side view of multiple main bodies of the present invention stacked on top of each other.
Figure 14A:
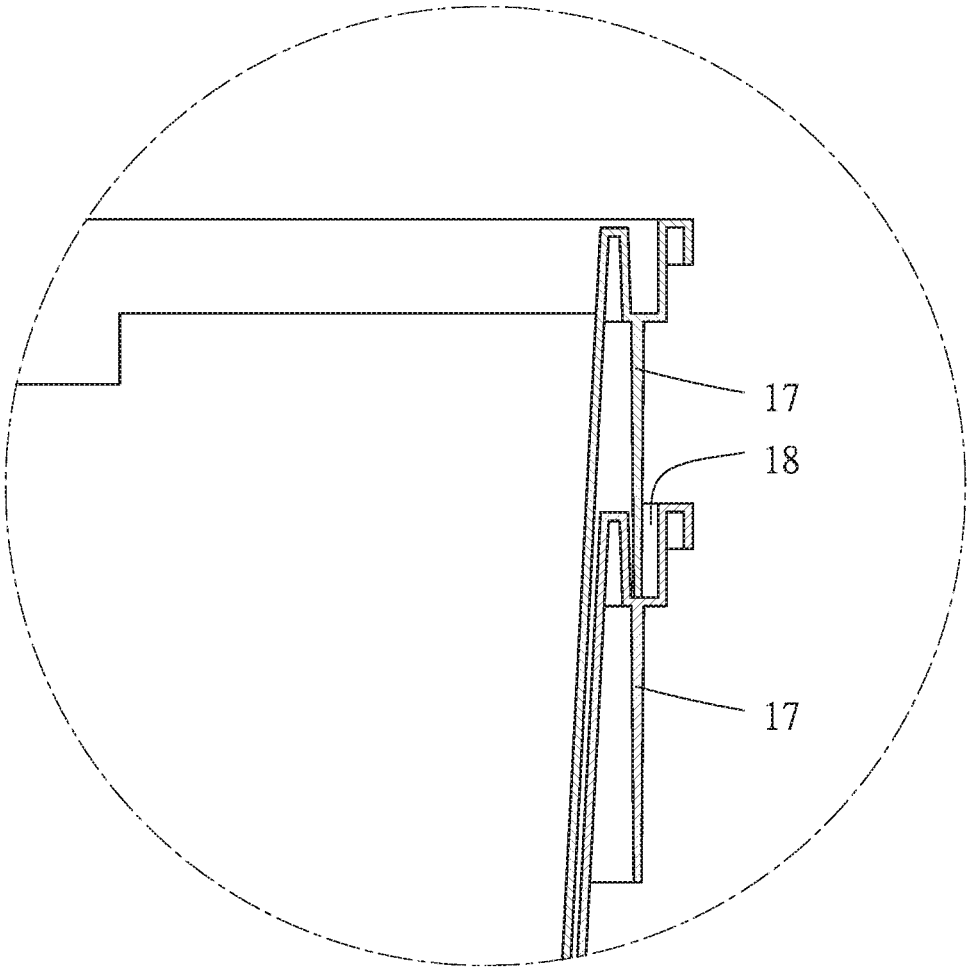
FIG. 14A is an enlarged view of A in FIG. 14.

The storage box referred to above includes a raising support of extending channels on a predetermined part of the outer side of the upper periphery of the main body (1) (as shown in FIG. 14), which when multiple main bodies (1) are not being used and are stacked with one another, said raising support (17) is positioned in the corresponding indented section (18) of the adjacent main body (1) below (as shown in FIG. 14A) to maintain an appropriate interval and facilitate being unstacked for further use.

Figure 15:
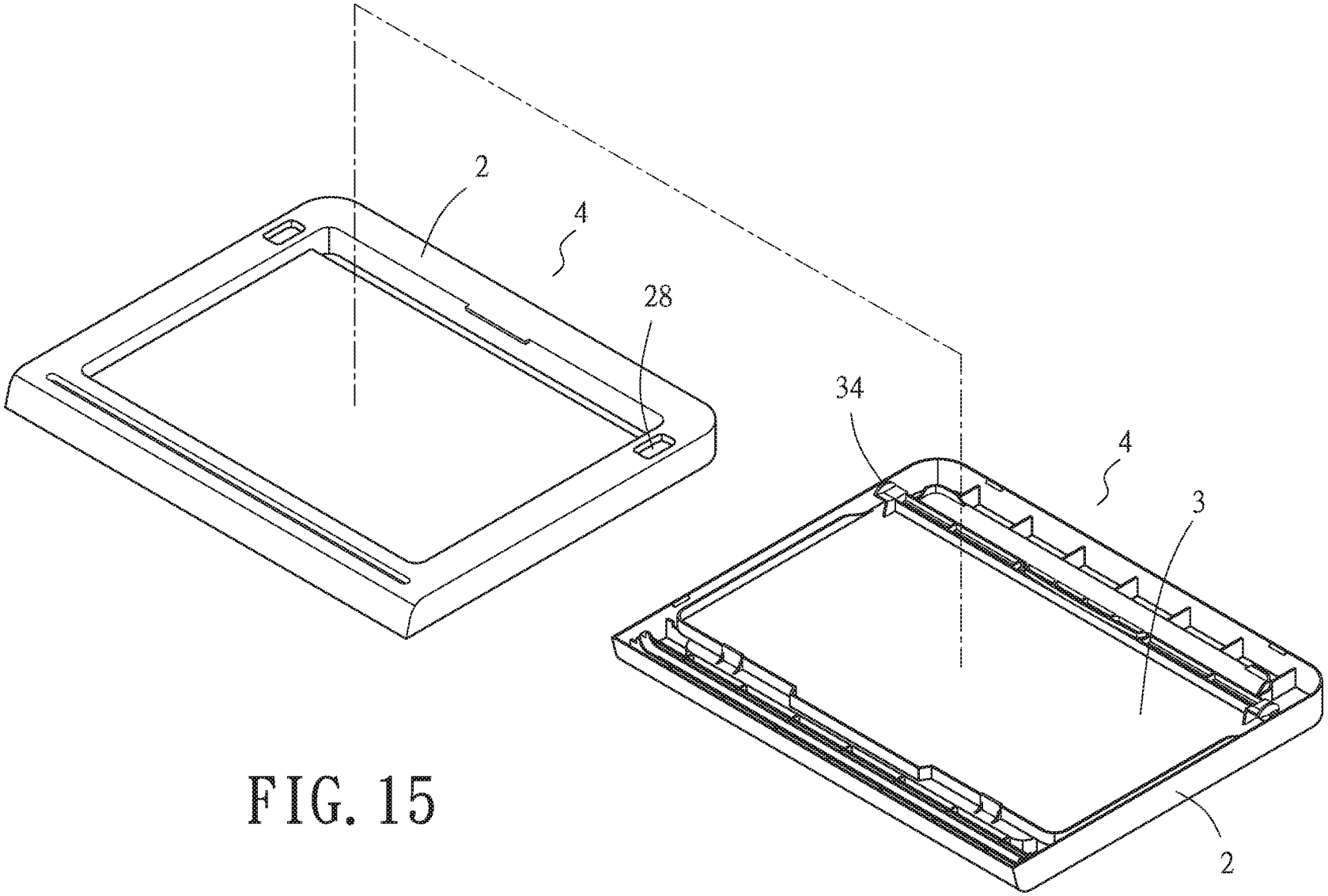
FIG. 15 is a top and reverse view of multiple snap fitted stacking assemblies of the upper cover and front cover of the present invention before being stacked.

The storage box referred to above includes a concave portion (28) recessed on both sides at the rear of the upper cover (2) which covers the upper opening of the main body (1) (as shown in FIG. 10), and allows the snap fitted stacking assembly (4) of the upper cover (2) and front cover (3) when not in use and being stacked with one another (as shown in FIG. 15) to be introduced into the rounded convex portion (34) on the corresponding part of the front cover (3) on the inside so that the upper and lower stacking assemblies (4) can be stacked in a stable manner

What is claimed is:

1. An improved structure of a storage box comprising:

a main body having front and rear portions, with an upper and front-facing opening, the upper and front-facing opening having a top opening and a forward opening, and a recess in a rear wall, opposite to the forward opening, of the rear portion of the main body; and a stacking assembly attached to the main body, said stacking assembly configured to cover the upper and front-facing opening, wherein the stacking assembly has an upper cover and a front cover, the upper cover fitted to the front cover by snap-fitting, and wherein the upper cover has a convex portion, wherein a shape of the convex portion corresponds to a shape of the recess in the rear wall on the rear portion of the main body, wherein the forward opening is covered by the front cover, wherein the upper cover and front cover of the stacking assembly further comprise a limiting section formed at a front section on an inside of said upper cover, and, at a back section of the inside of said upper cover, a pair of snap portions facing the limiting section, wherein when the front cover is correspondingly positioned with the upper cover, a lower concave portion on a front side of a periphery of the front cover is configured to be pushed in and held by said limiting section, and a periphery of the front cover on a side of the front cover opposite to the front side snaps into the pair of snap portions wherein the front cover is snapped to an inner surface of the upper cover; and a clasp portion on an inner periphery of the upper cover, wherein the clasp portion has several channels to allow the upper cover to snap into a bottom portion of an annular flange of the main body.

2. The improved structure of a storage box according to claim 1, further comprising a groove recessed into a section of the inside of said upper cover, and a reinforcing panel positioned within said groove.

3. The improved structure of a storage box according to claim 1, further comprising a lower surface formed towards the front portion of an inside of the main body, wherein the front cover on the bottom of the stacking assembly is configured to be pushed in or slid out along said lower surface by means of a slightly protruding rounded convex portion on each side of the front cover.

4. The improved structure of a storage box according to claim 1, further comprising a concave portion protruding from a back section of an outside surface of the upper cover, a shape of the concave portion corresponding to a bottom adjacent concave portion on a bottom of the main body of the storage box into which it is configured to be introduced when stacking, and wherein the main body has a plurality of convex portions protruding from corners, wherein the plurality of convex portions correspond to a recessed area in a middle of the upper cover.

5. The improved structure of a storage box according to claim 1, further comprising a raising support of extending channels on an outer side of an upper periphery of the main body, said raising support configured to be positioned in a corresponding indented section of an adjacent main body.

6. The improved structure of a storage box according to claim 1, further comprising two concave portions, one of each of the two concave portions recessed on opposite sides at a rear portion of the upper cover, each of said two concave portions configured to be introduced into a corresponding rounded convex portion on a corresponding part of the front cover on an inside surface.

* * * * *